US006036478A

United States Patent [19]

Inada

[11] Patent Number: 6,036,478

[45] Date of Patent: Mar. 14, 2000

[54] FIRE-LIGHTING DEVICE

[75] Inventor: Tsutomu Inada, Shizuoka-ken, Japan

[73] Assignee: Tokai Corporation, Shizuoka-Ken, Japan

[21] Appl. No.: 09/208,114

[22] Filed: Dec. 9, 1998

[30] Foreign Application Priority Data

Dec. 10, 1997 [JP] Japan ..... 9-339747

[51] Int. Cl.[7] ..... F23D 14/28

[52] U.S. Cl. ..... 431/344; 431/276; 431/254; 431/255; 431/156; 431/142; 431/131

[58] Field of Search ..... 431/344, 276, 431/254, 255, 156, 142, 131

[56] References Cited

U.S. PATENT DOCUMENTS

| | | | |
|---|---|---|---|
| 2,620,643 | 12/1952 | Nissen | 431/150 |
| 3,884,618 | 5/1975 | Neyret | 431/254 |
| 5,018,965 | 5/1991 | Ichikawa | 431/344 |

*Primary Examiner*—Larry Jones
*Attorney, Agent, or Firm*—Baker & Botts, LLP

[57] ABSTRACT

A fire-lighting device includes a jetting nozzle for jetting fuel gas, a gas passage for fuel gas to be burned extending from a fuel tank to the jetting nozzle, and a sintered filter made of sintered powder inserted in the gas passage upstream of a small-diameter portion. Provision of the sintered filter prevents obstruction of fuel supply by foreign matter clogging the gas passage at a nozzle plate of the jetting nozzle.

4 Claims, 2 Drawing Sheets

FIRE-LIGHTING DEVICE

BACKGROUND OF THE INVENTION

1. Field of the Invention

This invention relates to a gas cigarette lighter, multi-purpose lighter or other such fire-lighting device that vaporizes fuel gas stored in a fuel tank and burns the vaporized gas as it is jetted from a jetting nozzle, particularly to the fuel supply device thereof.

2. Description of the Related Art

In a gas cigarette lighter, multi-purpose lighter or other such fire-lighting device, particularly in an internal combustion (premixed combustion system) fire-lighting device that effects ignition and burning after premixing air with the fuel gas jetted from the jetting nozzle, the opening of the jetting nozzle (nozzle plate) is made very small (diameter: 50–100 μm) in order to jet gas at a high flow rate. Since this small-diameter portion is easily clogged by foreign matter, lighting (ignition) failure tends to occur because of insufficient gas jetting.

For overcoming this drawback, Japanese Utility Model Publication No.5(1993)-18609 teaches a technique of installing a filter made of woven or non-woven metallic fiber fabric upstream of the jetting nozzle or at the primary air intake so as to catch dust or other foreign matter before it can adhere to and clog the jetting nozzle.

The installation of such a filter made of woven or non-woven metallic fiber fabric does not, however, completely prevent the problem of lighting failure owing to clogging of the jetting nozzle.

To determine the specific reason for this, a fire-lighting device that experienced such nozzle clogging was disassembled and the foreign matter adhering to the jetting nozzle (nozzle plate) was analyzed. The analysis revealed the presence of dioctyl phthalate (DOP). DOP is a highly viscous substance commonly blended with rubber materials as a plasticizer and is generally contained in the O-rings, valve rubber and other rubber seal members used in a fire-lighting device.

When such rubber seal members come in contact with the fuel gas, DOP contained therein is eluted into the gas. Tests showed that when the fuel gas is jetted from the jetting nozzle to be burned, the gas pressure drives the eluted matter up to the jetting nozzle, where it adheres to and clogs the nozzle portion. Since the eluted DOP is in the form of a viscous liquid, the gas pressure can force some of it even through a metallic fiber filter membrane of the foregoing type installed in the fuel gas passage. It can therefore reach the small-diameter portion, where it adheres strongly owing to its high viscosity. The adhering DOP is not blown entirely away by the jetted gas but accumulates as an oily mass to obstruct jetting of the gas. It also catches ambient dust and other foreign particles that further obstruct gas jetting. As such, it is a cause of lighting failure.

Eluted plasticizer is not the only reason for clogging of the small-diameter portion of the jetting nozzle. Others causes include metal powder particles produced at the time of component machining and dust etc. that gets into the fire-lighting device during assembly.

In view of the foregoing problems, this invention aims to provide a fire-lighting device that effectively prevents clogging of the jetting nozzle in the gas passage by foreign matter.

SUMMARY OF THE INVENTION

For overcoming the foregoing problems, this invention provides a fire-lighting device comprising a jetting nozzle for jetting fuel gas, a gas passage for fuel gas to be burned extending from a fuel tank to the jetting nozzle, and a sintered filter made of sintered powder inserted in the gas passage upstream of a small-diameter portion.

The sintered filter is preferably made of sintered polyethylene powder.

In a preferable configuration, the jetting nozzle in the gas passage comprises a nozzle plate formed with a small hole of prescribed diameter and the sintered filter is inserted in the gas passage upstream of the nozzle plate. In a further preferable configuration, the sintered filter is installed in a joint rubber fitted in a tip portion of a joint nozzle provided upstream of the jetting nozzle.

The sintered filter inserted in the gas passage upstream of the small-diameter portion catches eluted plasticizer and other foreign matter passing through the gas passage with the gas to prevent the foreign matter from adhering to and clogging the small-diameter portion of the nozzle plate or the like of the jetting nozzle or any flow splitter or the like that may be provided. The invention thus ensures proper combustion with no occurrence of lighting failure owing to fuel supply obstruction.

Of particular note is that the sintered filter has voids shaped to catch large masses of eluted plasticizer and includes three-dimensionally structured gas passages. Even if a portion of the sintered filter is blocked by adherence of eluted plasticizer or the like, it can still maintain long-term overall gas-permeability and gas-passage property, while also providing strong foreign matter holding power that does not permit passage of foreign matter by the gas pressure.

When a sintered filter made by sintering polyethylene powder is used, it can be constituted of the same material as has conventionally been used for the draw-up wick of a fire-lighting device. Since the draw-up wick material can therefore also be used as the sintered filter material, the cost of production is kept down.

In the fire-lighting device provided in its gas passage with a nozzle plate formed with a small hole of prescribed diameter, the sintered filter can be easily installed in, for example, the joint rubber present upstream of the nozzle plate.

DESCRIPTION OF THE PREFERRED EMBODIMENT

An embodiment of the invention will now be explained in detail with reference to the drawings.

Figure 1:
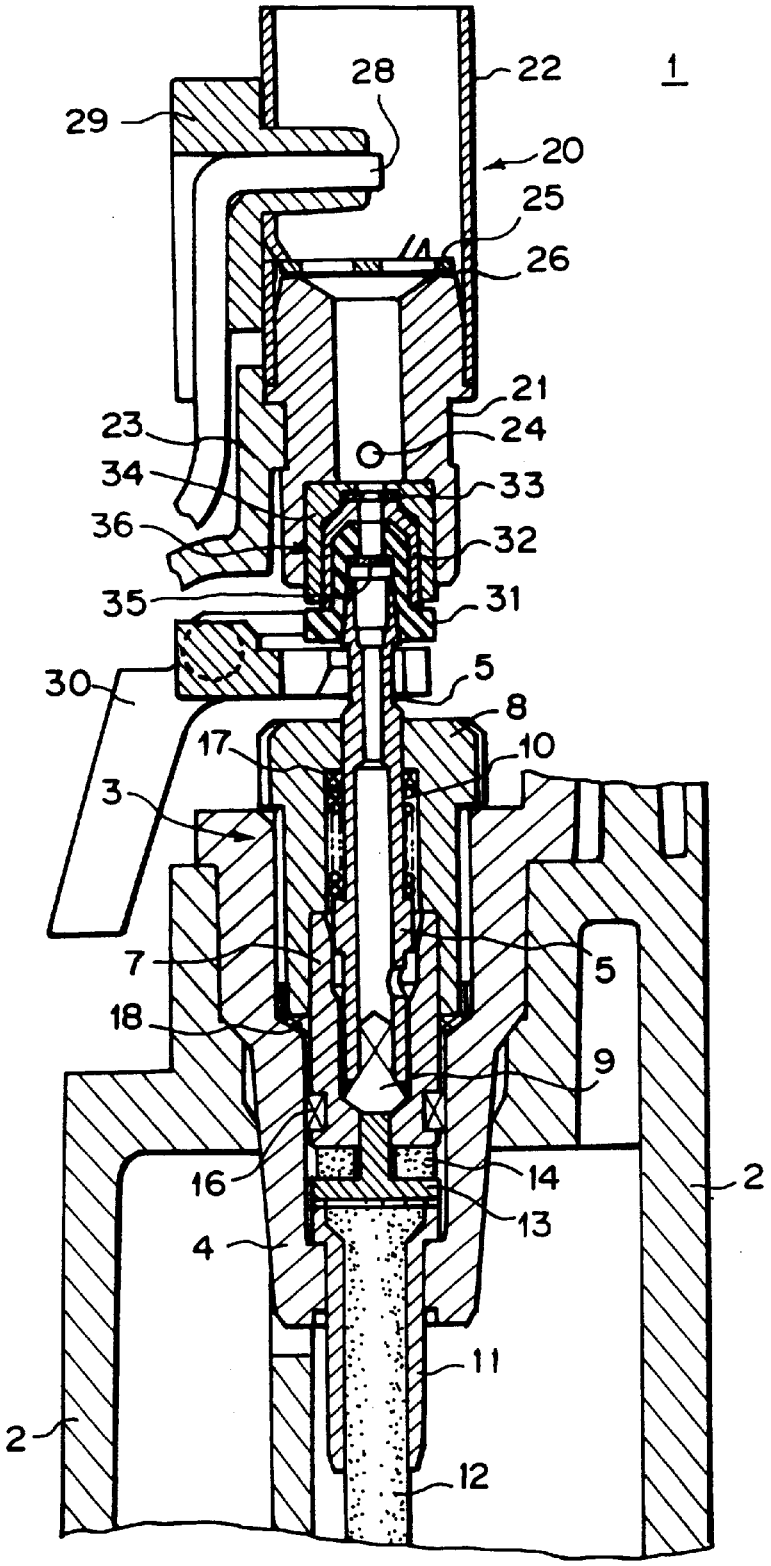
FIG. 1 is a sectional view of the essential portion of a fire-lighting device that is an embodiment of the invention.
Figure 2:
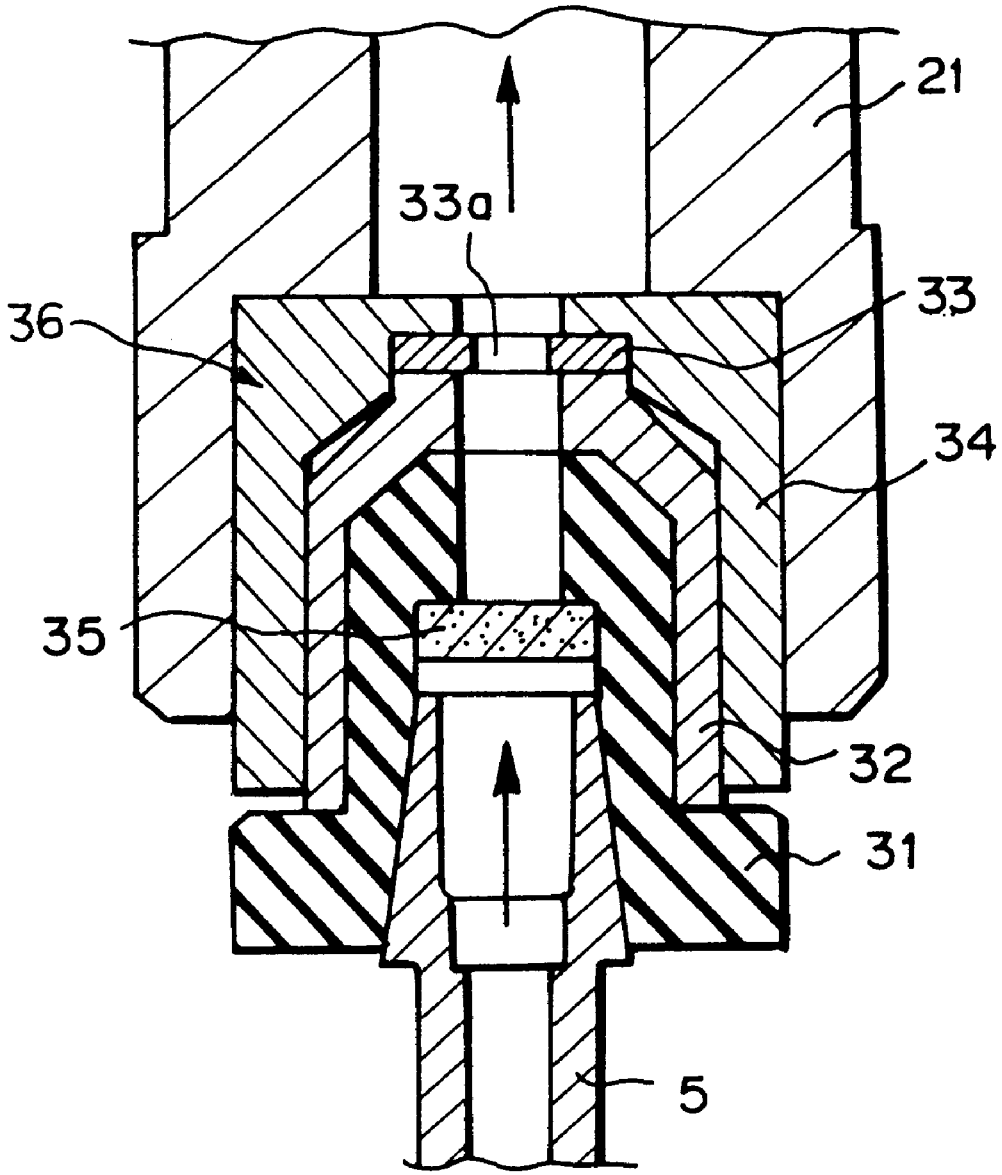
FIG. 2 is an enlarged view of an essential portion of FIG. 1.

FIG. 1 shows the sectional structure of the essential portion of a gas cigarette lighter as an example of an embodiment of the fire-lighting device according to the invention. FIG. 2 is an enlarged view of an essential portion of the lighter.

This gas cigarette lighter, designated by reference numeral 1, is of conventional structure. It has a main tank body 2 for storing fuel gas at its lower portion. The main tank body 2 is formed of synthetic resin and holds a high-pressure fuel gas such as butane gas. A valve device 3 including a joint nozzle 5 for jetting the fuel gas is mounted on top of the main tank body 2 as accommodated in a valve housing 4. A burner 21 and a combustion cylinder 20 defined by a combustion tube 22 are installed above the joint nozzle 5 to establish a gas passage for burning the fuel gas jetted from the joint nozzle 5. As its gas burning system, the combustion cylinder 20 utilizes the primary air mixed internal combustion system involving intake and mixing of primary air.

A piezoelectric unit (not shown) is disposed at the side of the valve device 3. An operation member (not shown) is provided on top of the piezoelectric unit for operating the joint nozzle 5 to jet fuel gas and operate the piezoelectric unit to ignite the jetted fuel gas. The combustion cylinder 20 is mounted on the main tank body 2 as retained by an internal housing 23.

The valve device 3 jets gas from its tip when a passage is opened by upward movement of the joint nozzle 5. An L-shaped operation lever 30 having one end portion engaged with the joint nozzle 5 is rotatably supported at a pivot point midway thereof. An operation section at the other end thereof is rotatably operated in response to operation of the aforesaid operation member to start and stop jetting of gas by the joint nozzle 5.

As best shown in FIG. 2, a joint rubber 31 and a jetting nozzle 36 are interposed between the tip portion of joint nozzle 5 and the burner 21 defined by the combustion cylinder 20. Each of these members is provided with a center hole for forming a gas passage.

The tip portion of the joint nozzle 5 is inserted into the bottom of the joint rubber 31 and can be advanced and retracted. The jetting nozzle 36 is inserted into the bottom of the burner 21.

The jetting nozzle 36 consists of a plate presser 32, a nozzle plate 33 and a plate holder 34. The nozzle plate 33 is fixed as pinched between the plate presser 32 and the plate holder 34 and the upper portion of the joint rubber 31 is fitted into the internal space of the plate presser 32. The nozzle plate 33 is formed with a small hole 33*a* of prescribed diameter (e.g., 50–70 $\mu$m) to enable gas to be jetted into the burner 21 at high velocity.

A sintered filter 35 made of sintered powder is inserted into the interior of the joint rubber 31 to be present in the gas passage at a position facing the opening at the tip of the joint nozzle 5. The sintered filter 35 is formed as a porous member made from polyethylene powder (mean particle size of, e.g, 140 mesh) that has been sintered (e.g., for 10 min at 170° C.) to form a sintered body. The sintered filter 35 is typically a disk with a diameter of 1.5 mm and a thickness of 0.5 mm.

The valve housing 4 is fitted into the main tank body 2 made of synthetic resin. A valve main body 7 is inserted into a mounting hole formed to pass through the interior of the valve housing 4 and a fastening member 8 is screwed therein to press onto the valve main body 7. The thin, tube-like joint nozzle 5 is disposed inside the valve main body 7 and the fastening member 8 to be free to slide in its axial direction.

The joint nozzle 5 has an internal passage whose one end (upper end) projects from the center of the fastening member 8 as a jetting port, whose other (lower) end is closed by a valve body 9 inserted therein, and whose middle portion communicates with the surrounding portion through an opening. A hole formed at the center of the lower end portion of the valve main body 7 constitutes a valve seat for the valve body 9, whereby this center hole can be opened and closed. The joint nozzle 5 is urged in the seating direction by a valve spring 10 compressed between itself and the upper inner surface of the fastening member 8.

A draw-up wick 12 made of porous material is inserted into a wick holder 11 and fitted into the bottom of the valve housing 4. A flow rate regulation filter 14 is disposed at the upper end of the wick holder 11 as retained by a nail-like fastener 13.

An O-ring 16 for establishing a gas seal is fitted between the outer periphery of the valve main body 7 and the inner surface of the valve housing 4 and an O-ring 17 (threaded O-ring) for establishing a gas seal is provided between the outer periphery of the joint nozzle 5 and the inner surface of the fastening member 8. The O-ring 17 is in contact with one end of the valve spring 10. An O-ring 18 (seal ring) is further fitted between the tip portion of the fastening member 8 and a step portion of the inner surface of the valve housing 4.

The combustion cylinder 20 consists of the burner 21 at the base and the combustion tube 22, which is fastened to and extends upward from the burner 21. The gas passage extends through the center region of the burner 21. A primary air hole 24 is formed in the side surface of the burner 21 at a point near the bottom thereof located above the plate holder 34 fitted therein.

A vortex plate 25 and a metal mesh member 26 are placed on the upper end portion of the burner 21. A discharge electrode 28 is held by an electrode holder 29 to pass through the side of the combustion tube 22 with its tip facing into the interior thereof.

When the operation lever 30 is rotated, the joint nozzle 5 is raised against the force of the valve spring 10 to separate the valve body 9 from the valve seat of the valve main body 7. Fuel gas rising from the tank through the draw-up wick 12 passes around the outer periphery of the nail-like fastener 13 and then from the peripheral portion of the flow rate regulation filter 14 toward the center thereof. The flow rate-regulated gas passes from the interior of the valve main body 7 through the portion surrounding the joint nozzle 5 into the internal passage of the joint nozzle 5 to be jetted from the tip thereof. The fuel gas jetted from the joint nozzle 5 passes through the sintered filter 35, which removes any entrained foreign matter, and then through the small hole 33*a* of the nozzle plate 33 of the jetting nozzle 36 and into the gas passage of the burner 21 at high velocity. The low pressure produced in proportion to the flow velocity and quantity of the inflowing gas sucks in primary air through the primary air hole 24 in the side of the burner 21. The inflowing gas and the primary air are mixed by passage through the metal mesh member 26 and the vortex plate 25 and the mixed gas rises into the combustion tube 22. The mixed gas then burns upon being ignited by spark discharge from the discharge electrode 28.

Since the sintered filter 35 is disposed near the upstream side of the nozzle plate 33 of the jetting nozzle 36 where the gas passage is narrowest and most susceptible to adherence of foreign matter, any plasticizer eluted from the rubber components is caught by the sintered filter 35 and prevented from reaching the nozzle plate 33. Degradation of the fuel gas supply performance by clogging is therefore prevented to ensure excellent lighting and burning performance.

The location of the sintered filter 35 is not limited to that in the described embodiment. It can, for example, instead be overlaid on the nozzle plate 33, be installed in the internal passage of the joint nozzle 5, or, in a structure with no nozzle plate 33, be installed in the gas passage upstream of the jetting port of the joint nozzle 5.

What is claimed is:

1. A fire-lighting device comprising a jetting nozzle for jetting fuel gas, a gas passage for fuel gas to be burned extending from a fuel tank to the jetting nozzle, a valve in the fuel passage for controlling the flow of fuel gas to the jetting nozzle, and a sintered filter made of sintered powder inserted in the gas passage upstream of a small-diameter portion in the jetting nozzle and downstream of the valve.

2. A fire-lighting device according to claim 1, wherein the sintered filter is made of sintered polyethylene powder.

3. A fire-lighting device according to claim 1 or 2, wherein the jetting nozzle in the gas passage comprises a nozzle plate formed with a small hole of prescribed diameter and the sintered filter is inserted in the gas passage upstream of the nozzle plate.

4. A fire-lighting device according to claim 3, wherein the sintered filter is installed in a joint rubber fitted in a tip portion of a joint nozzle provided upstream of the jetting nozzle.

* * * * *